US006820398B2

(12) United States Patent
Tale'et al.

(10) Patent No.: US 6,820,398 B2
(45) Date of Patent: Nov. 23, 2004

(54) METHOD OF WRAPPING ELONGATED ARTICLES IN GROUPS

(75) Inventors: Fabrizio Tale', Bologna (IT); Mario Spatafora, Bologna (IT)

(73) Assignee: G.D Societa' per Azioni, Bologna (IT)

( * ) Notice: Subject to any disclaimer, the term of this patent is extended or adjusted under 35 U.S.C. 154(b) by 0 days.

(21) Appl. No.: 10/320,939

(22) Filed: Dec. 17, 2002

(65) Prior Publication Data

US 2003/0140604 A1 Jul. 31, 2003

(30) Foreign Application Priority Data

Dec. 21, 2001 (IT) ..... BO2001A0775

(51) Int. Cl.[7] ..... B65B 11/06

(52) U.S. Cl. ..... 53/466; 53/461; 53/228; 53/234

(58) Field of Search ..... 53/461, 466, 228, 53/232, 234

(56) References Cited

U.S. PATENT DOCUMENTS

| | | | | |
|---|---|---|---|---|
| 4,823,536 A | | 4/1989 | Manservigi et al. | |
| 5,177,933 A | | 1/1993 | Boriani et al. | |
| 5,392,586 A | * | 2/1995 | Imai | 53/234 |
| 5,457,932 A | * | 10/1995 | Spada et al. | 53/234 |
| 5,701,725 A | * | 12/1997 | Neri et al. | 53/466 |
| 5,822,948 A | * | 10/1998 | Manservigi et al. | 52/466 |
| 6,047,529 A | * | 4/2000 | Draghetti | 53/466 |
| 6,085,494 A | | 7/2000 | Lembke et al. | |
| 6,219,995 B1 | * | 4/2001 | Boldrini et al. | 53/234 |
| 6,470,651 B1 | * | 10/2002 | Polazzi et al. | 53/466 |
| 6,643,996 B2 | * | 11/2003 | Spatafora et al. | 53/466 |

FOREIGN PATENT DOCUMENTS

| | | |
|---|---|---|
| DE | 37 13 332 | 12/1987 |
| EP | 0 806 350 | 11/1997 |
| EP | 1 035 021 | 9/2000 |
| GB | 2 191 166 | 12/1987 |

* cited by examiner

*Primary Examiner*—Louis Huynh
(74) *Attorney, Agent, or Firm*—Marshall, Gerstein & Borun LLP

(57) ABSTRACT

A method of wrapping elongated articles in groups provides for feeding a first and a second pocket continuously along two respective paths having a common portion, along which the first pocket penetrates the second pocket to transfer a group from the first to the second pocket together with a sheet of wrapping material, which is folded into a U inside the second pocket and has two parallel, opposite flaps gripped between first and second lateral walls; and for compressing the group between a first and a second bottom wall and, at the same time, extracting the first lateral walls from the second pocket.

13 Claims, 5 Drawing Sheets

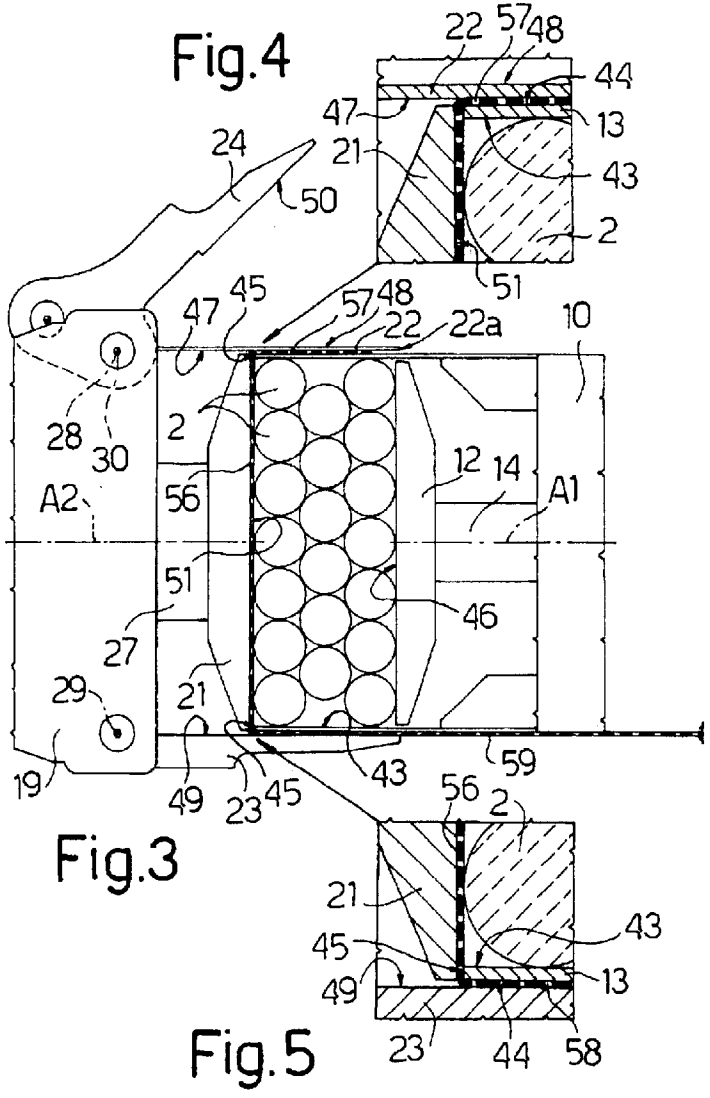
Fig.4
Fig.3
Fig.5
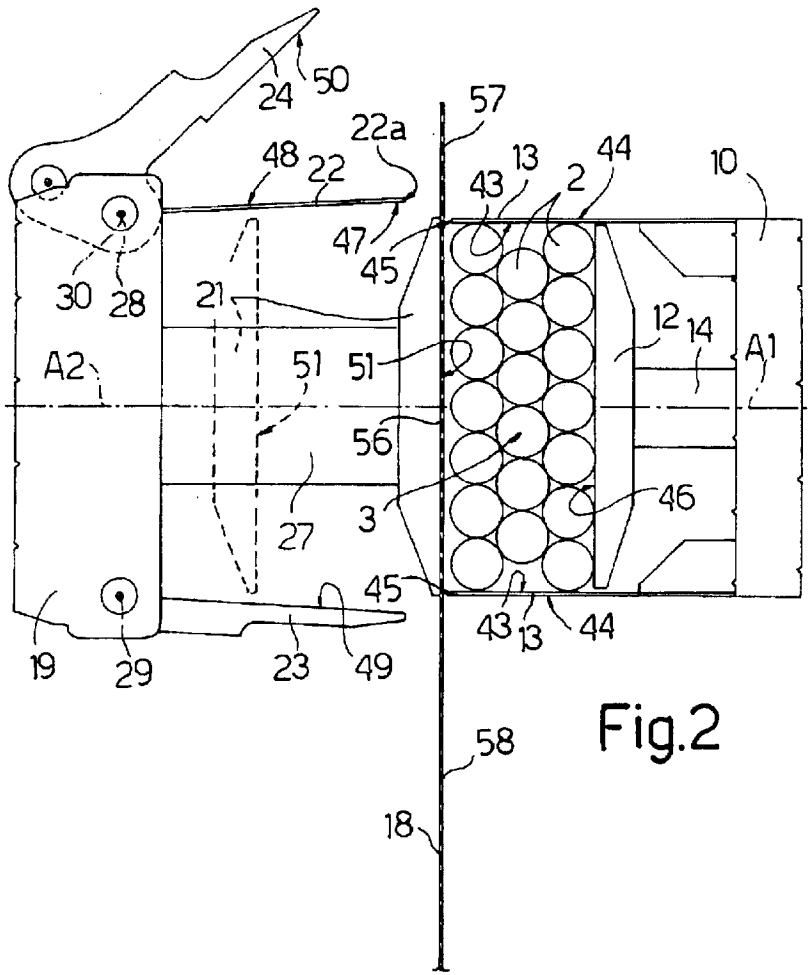
Fig.2

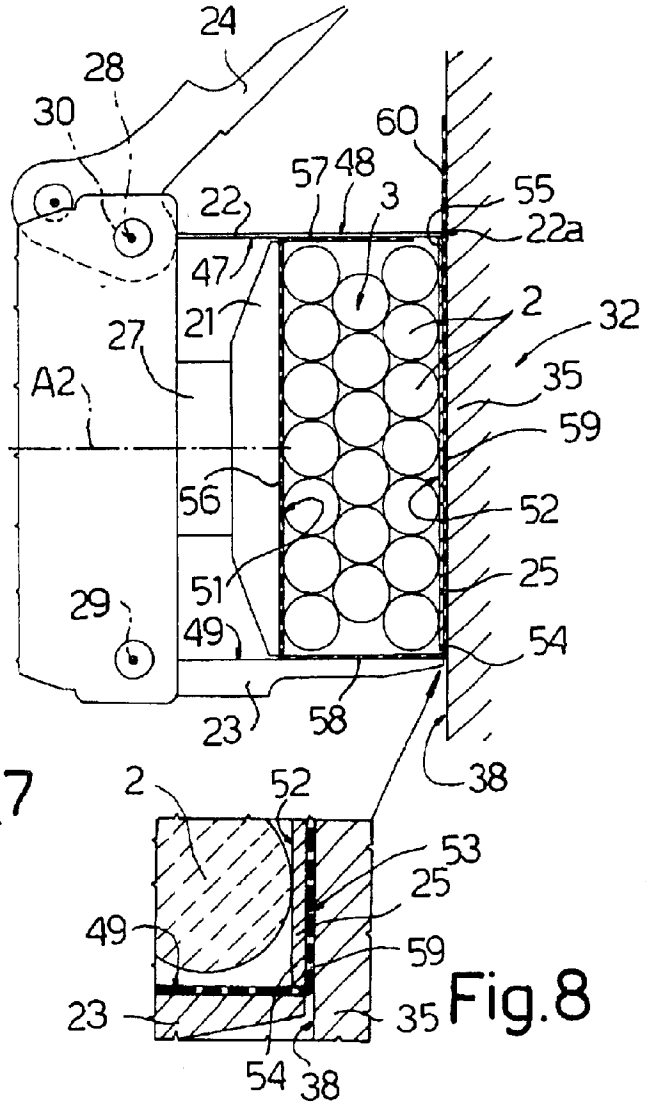
Fig.7
Fig.8
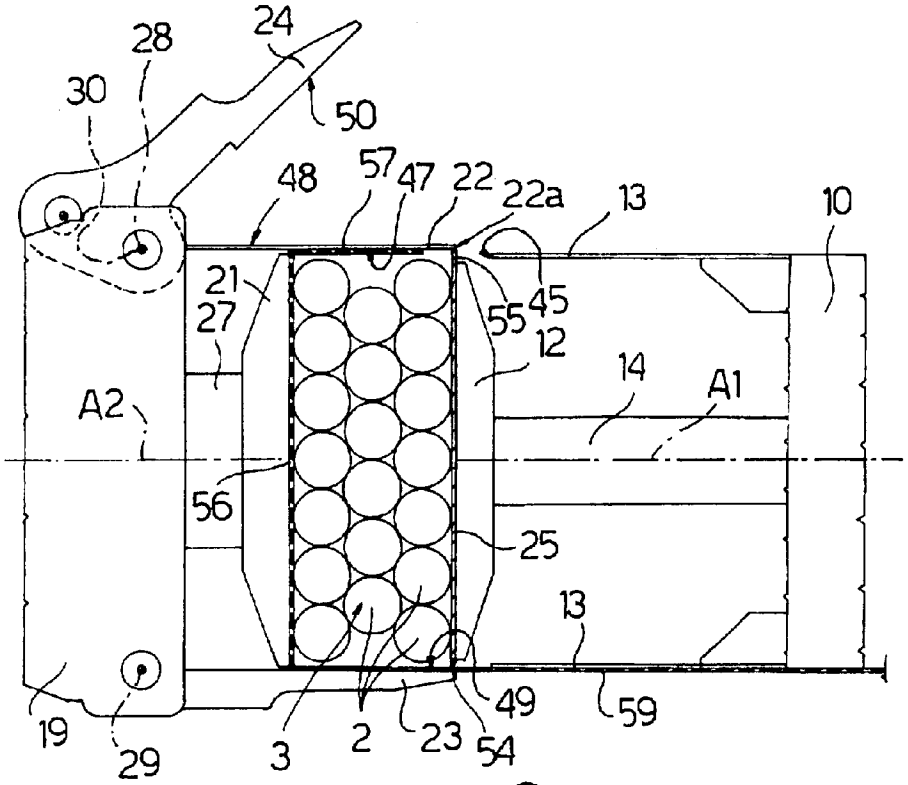
Fig.6

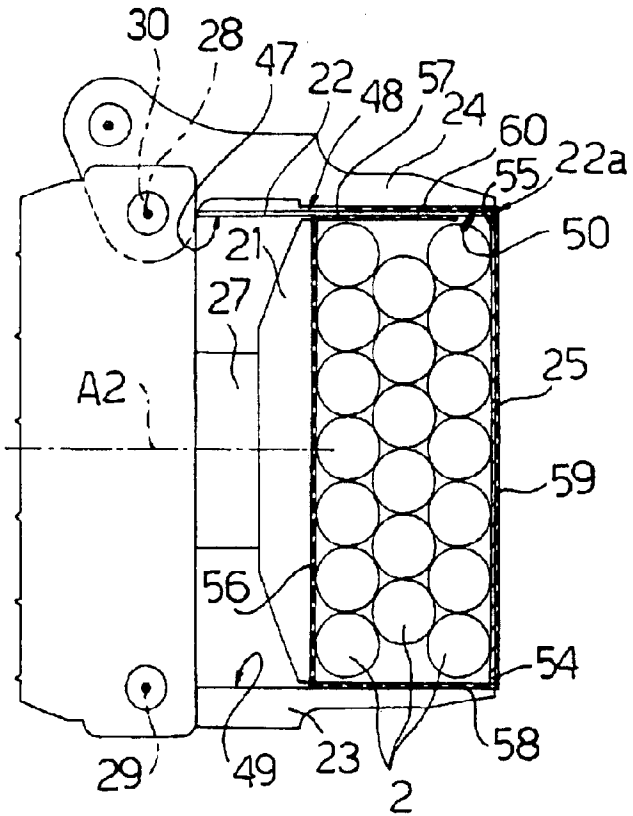
Fig. 13
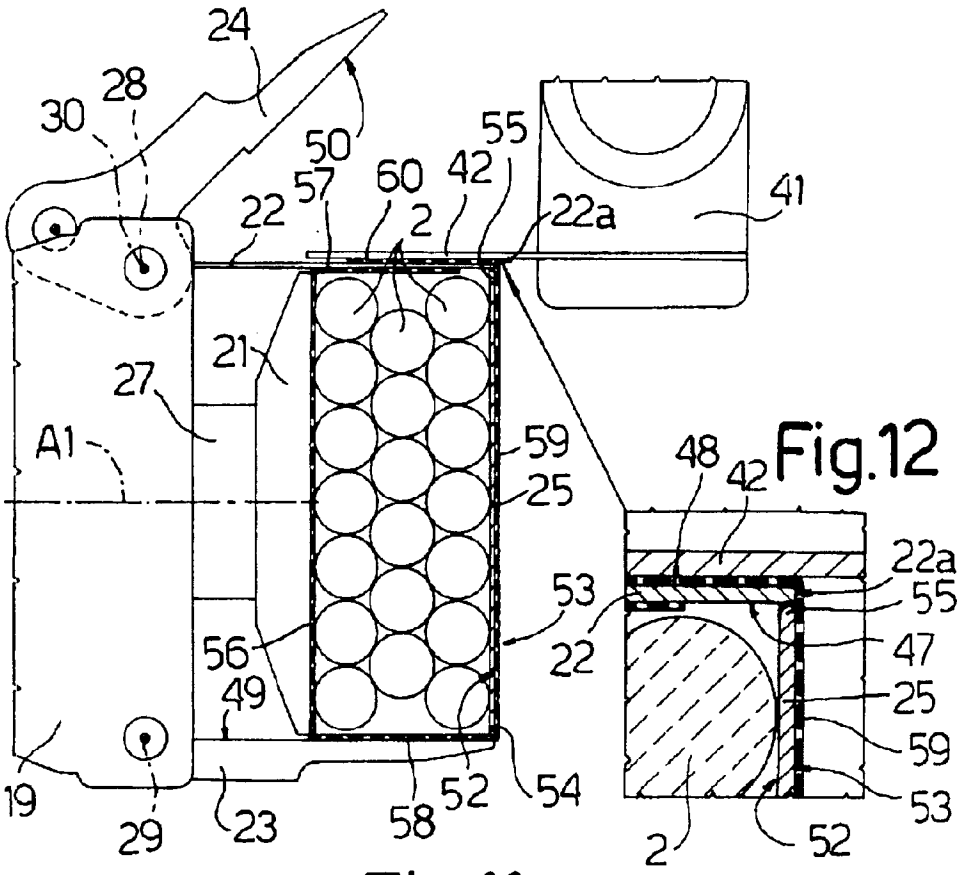
Fig.11
Fig.12

METHOD OF WRAPPING ELONGATED ARTICLES IN GROUPS

The present invention relates to a method of wrapping elongated articles in groups.

More specifically, the present invention relates to a method of wrapping orderly groups of cigarettes, to which the following description refers purely by way of example.

BACKGROUND OF THE INVENTION

Methods of wrapping orderly groups of cigarettes—hereinafter referred to simply as "groups"—normally comprise folding a sheet of wrapping material about a group to form a tubular wrapping; and closing two tubular portions, projecting from opposite ends of the group, onto the group itself. Formation of the tubular wrapping comprises a first folding step wherein the sheet of wrapping material is folded into a U; a second folding step wherein a first free flap of the sheet of wrapping material is folded into an L; and a third folding step wherein a second free flap of the sheet of wrapping material is folded into an L onto a third flap folded onto the group when making the U-shaped fold.

In known methods of a first type, the group is inserted inside a metal spindle, and a sheet of wrapping material is folded about the spindle. Methods of this type provide for forming sharp-edged folds—particularly appreciated in the cigarette manufacturing industry—but involve extracting the spindle from the tubular wrapping, thus slowing down the wrapping unit as a whole.

In known methods of a second type, the sheet of wrapping material is folded directly about the group, so that the tubular wrapping has rounded edges with a radius of curvature substantially equal to the diameter of the cigarettes.

Given the current emphasis, in automatic machine design, on producing continuously-operating machines to increase output, wrapping methods of the first type are more or less discarded, by extraction of the group and wrapping from the spindle not being adaptable to continuously-operating machines.

One known method of wrapping groups on a continuously-operating machine normally comprises feeding a first and a second pocket continuously along a first and, respectively, second path having a common portion, along which the first pocket penetrates the second pocket to transfer an orderly group of cigarettes from the first to the second pocket together with a sheet of wrapping material, which is folded into a U, when transferring the group, and is then folded about the group by folding devices located along the second path. The first pocket comprises a first bottom wall and two lateral walls, and the second pocket comprises a second bottom wall and second lateral walls. When making the U-shaped fold, a portion of the sheet of wrapping material is gripped between the group and the second bottom wall; and two opposite, parallel flaps of the sheet of wrapping material are gripped between the first and second lateral walls. The first and second pocket are then fed separately along the respective paths, and the first pocket, obviously, is extracted from the second. When extracting the first lateral walls, the sheet of wrapping material may slip with respect to the second pocket and to the group housed inside the second pocket, even to the extent of impairing subsequent folds and formation of the wrapping as a whole. On the other hand, it is extremely difficult to determine the conditions resulting in such a difference in friction between the two first lateral walls and the flaps as to cause slippage of the sheet of wrapping material.

SUMMARY OF THE INVENTION

It is an object of the present invention to provide a method of wrapping elongated articles in groups, which may be implemented easily on an automatic, continuously-operating machine of the type described above, and which at the same time provides for preventing slippage of the sheet of wrapping material during the folding operations.

According to the present invention, there is provided a method of wrapping elongated articles in groups, the method comprising feeding a first and a second pocket continuously along a first and, respectively, second path having a common portion, along which the first pocket penetrates the second pocket to transfer a group from the first to the second pocket together with a sheet of wrapping material, the first and the second pocket comprising, respectively, a first and a second bottom wall, and first and second lateral walls; gripping a first and a second flap, opposite and parallel to each other, of the sheet of wrapping material between the first and second lateral walls; and extracting the first lateral walls from the second pocket; the method being characterized by compressing the group and a portion of the sheet of wrapping material between the first and second bottom wall when extracting the first lateral walls from the second pocket.

In other words, the sheet of wrapping material is compressed to prevent slippage of the sheet caused by extraction of the first lateral walls from the second pocket.

BRIEF DESCRIPTION OF THE DRAWINGS

A non-limiting embodiment of the present invention will be described by way of example with reference to the accompanying drawings, in which:

FIGS. 2, 3, 6, 7, 11 and 13 show side views, with parts in section and parts removed for clarity, of a detail of the FIG. 1 unit at successive steps in the method according to the present invention;

FIGS. 4, 5 show larger-scale side views of details in FIG. 3;

FIG. 8 shows a larger-scale side view of a detail in FIG. 7;

FIG. 12 shows a larger-scale side view of a detail in FIG. 11.

DETAILED DESCRIPTION OF THE INVENTION

Figure 1:
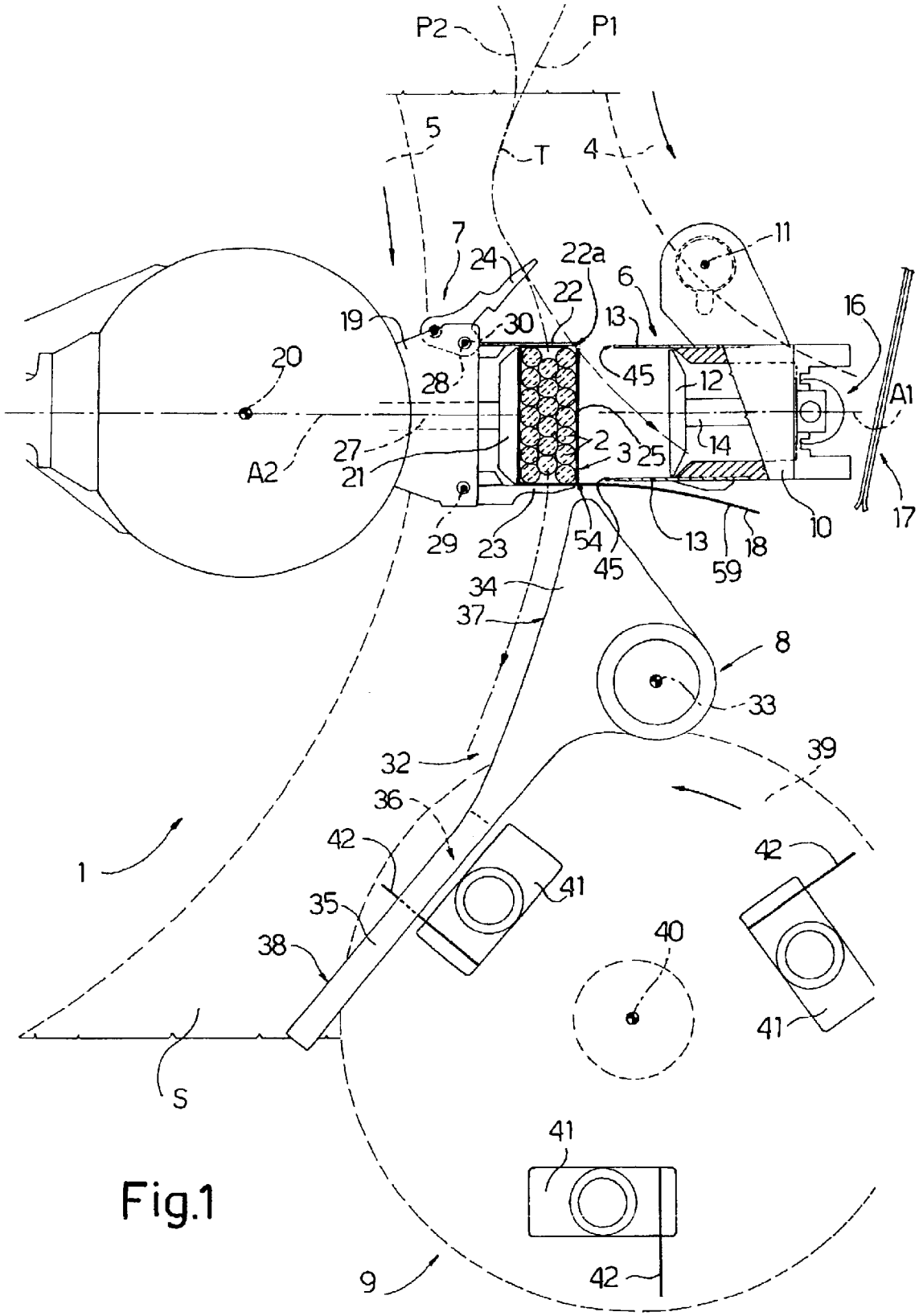
FIG. 1 shows a schematic side view, with parts in section and parts removed for clarity, of a unit for wrapping elongated articles in groups and implementing the method according to the present invention.

With reference to FIG. 1, number 1 indicates as a whole a unit for wrapping cigarettes 2 arranged in groups 3 on an automatic, continuously-operating wrapping machine not shown. Unit 1 comprises two wheels 4 and 5 shown by the dash lines in FIG. 1 and fitted to a structure S to rotate about respective parallel axes (not shown) perpendicular to the FIG. 1 plane. Wheels 4 and 5 respectively support two successions of pockets 6 and 7, only two of which are shown in FIG. 1, and which respectively travel along two endless paths P1 and P2 having a common portion T. Unit 1 also comprises two folding devices 8 and 9 located along path P2 and cooperating with pocket 7.

Pocket 6 comprises a frame 10 fitted to wheel 4 to rotate about an axis 11 perpendicular to the FIG. 1 plane; and a bottom wall 12 and two lateral walls 13 fixed to frame 10. Bottom wall 12 is movable with respect to frame 10 along an axis A1, and is integral with a rod 14 fitted in sliding manner to frame 10, and with a cam actuating device 16.

Lateral walls 13 are defined by two thin, flat, facing plates parallel to each other and to axis A1 and fixed rigidly to frame 10.

Downstream from each pocket 6, wheel 4 supports a gripper 17 extending radially from wheel 4, and which provides for withdrawing the end of a sheet 18 of wrapping material from a known device (not shown), and for drawing sheet 18 of wrapping material in front of pocket 6 along a portion of path P1.

Figure 9:
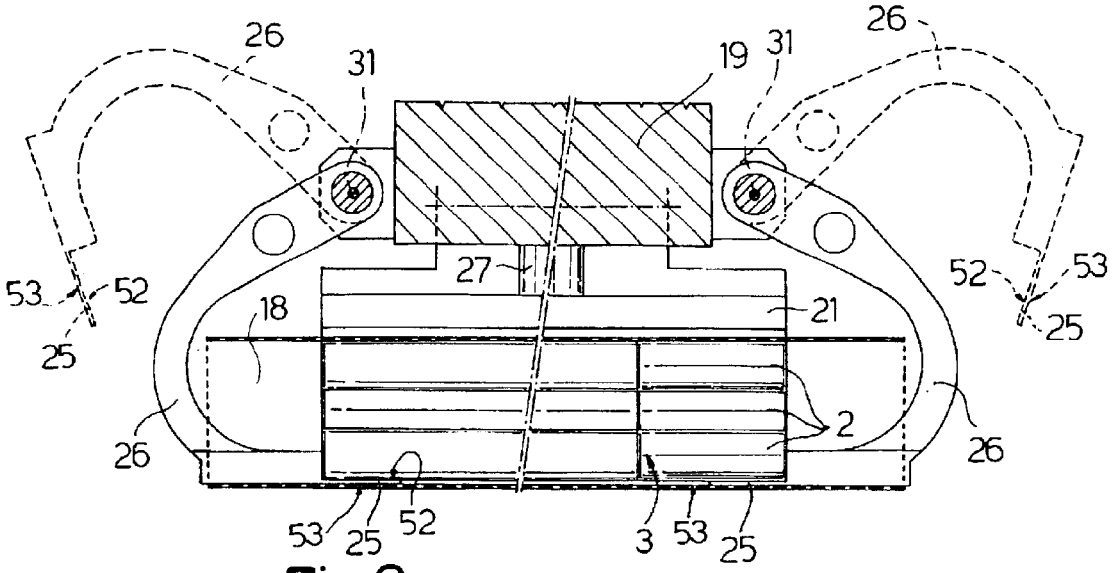
FIG. 9 shows a section, with parts removed for clarity, of a detail in FIG. 1.
Figure 10:
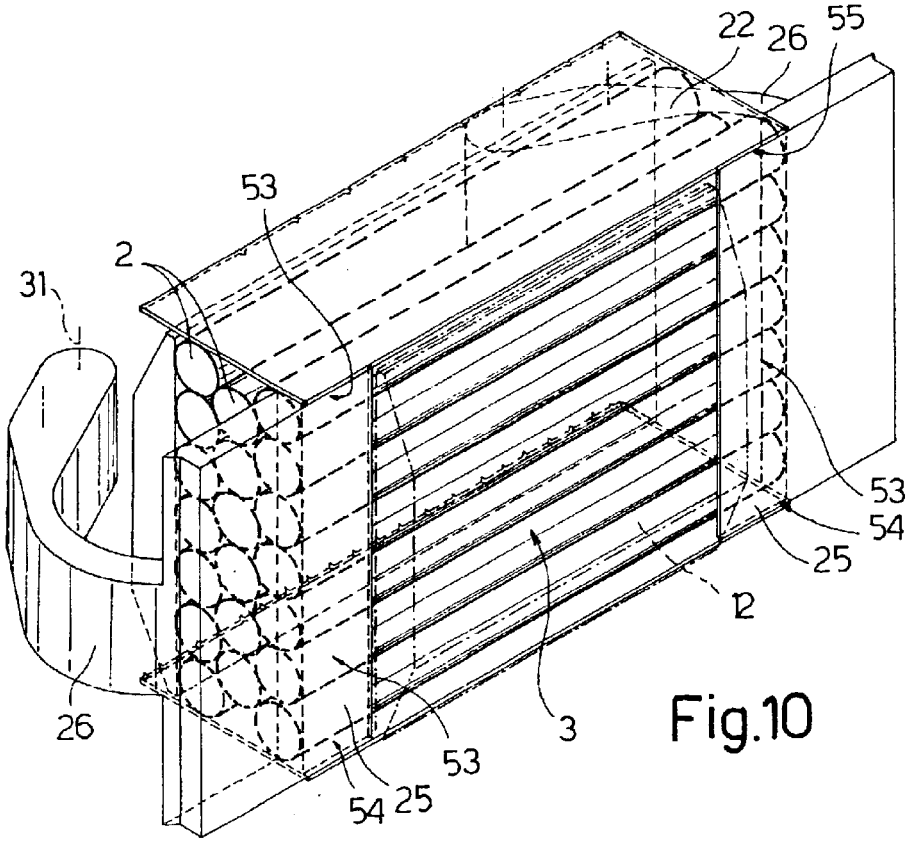
FIG. 10 shows a view in perspective of the FIG. 9 detail.

Each pocket 7 comprises a frame 19 fitted to wheel 5 to rotate about an axis 20 parallel to axis 11; a bottom wall 21 and two lateral walls 22 and 23; a jaw 24; and two plates 25 supported on U-shaped arms 26 and shown in FIGS. 9 and 10.

With reference to FIG. 1, bottom wall 21 is movable along an axis A2, and is fitted to a rod 27 guided by frame 19 and activated by a cam device not shown. Lateral walls 22 and 23 are mounted to rotate about respective axes 28 and 29, are activated by respective cam devices not shown, are located on opposite sides of bottom wall 21, and are movable between a rest position, and a work position in which they are parallel to each other and to axis A2. Jaw 24 is located on the wall 22 side, and rotates about an axis 30 coincident with axis 28. Wall 22 is defined by a thin, flat plate, and jaw 24 is movable between a rest position, and a work position in which it is parallel to walls 22 and 23 and adjacent to wall 22.

With reference to FIG. 9, plates 25 and respective arms 26 rotate, with respect to frame 19 and about respective axes 31 perpendicular to axes 28, 29 and 30, between a rest position, shown by the dash line, and a work position, shown by the continuous line.

With reference to FIG. 1, folding device 8 is fitted to structure S, and comprises a plate 32 mounted to rotate about an axis 33 perpendicular to the FIG. 1 plane. Plate 32 comprises a curved portion 34; and a flat portion 35 having slots 36 for the insertion of part of device 9. Curved portion 34 and flat portion 35 have respective faces 37 and 38 connected to each other and facing wheel 5.

Device 9 comprises a wheel 39 shown by the dash line in FIG. 1, and which rotates, with respect to structure S, about an axis 40 parallel to axis 33. Wheel 39 comprises three folding devices 41 equally spaced about axis 40 and having plates 42 which, in use, engage slots 36 comb-fashion and project from face 38.

With reference to FIG. 2, each lateral wall 13 of pocket 6 comprises an inner face 43 directly contacting group 3 in use, an outer face 44, and a free end 45; bottom wall 12 of pocket 6 comprises a face 46 contacting a central portion of group 3 in use; wall 22 comprises an inner face 47 and an outer face 48; wall 23 comprises an inner face 49; jaw 24 comprises an inner face 50; and bottom wall 21 of pocket 7 comprises a face 51.

With reference to FIG. 9, each plate 25 comprises an inner face 52 contacting the ends of cigarettes 2 in group 3 in use; an outer face 53; and two opposite ends 54 and 55 (FIG. 10).

In actual use, wheels 4, 5 and 39 rotate continuously, wheel 5 clockwise and wheels 4 and 39 anticlockwise in FIG. 1. As wheels 4 and 5 rotate, pockets 6 and 7 are swung about respective axes 11 and 20 by cam devices (not shown) known in the automation industry and comprising pawls, levers, and cam profiles (not shown) for moving pockets 6 and 7 into given positions with respect to wheels 4 and 5 along respective paths P1 and P2. The movements of lateral walls 22 and 23, jaw 24, bottom walls 12 and 21, plate 32, and folding devices 41 are controlled by similar cam devices also operated by rotation of wheels 4 and 5. Pockets 6 and 7 are fed continuously along respective paths P1 and P2, and are so timed and swung about respective axes 11 and 20 as to align axes A1 and A2 and insert pocket 6 inside pocket 7 along the common portion T of paths P1 and P2. As wheel 4 rotates, and upstream from portion T, gripper 17 grips a sheet 18 of wrapping material supplied in known manner not shown, and retains sheet 18 of wrapping material in a given position with respect to pocket 6.

With reference to FIG. 2, axes A1 and A2 are aligned, and bottom wall 21 is moved along axis A2 from the position shown by the dash line to the position shown by the continuous line, in which sheet 18 of wrapping material is gripped between face 51 of bottom wall 21 and ends 45 of walls 13. At this stage, gripper 17 releases sheet 18 of wrapping material, which has a portion 56 compressed between ends 45 of the two lateral walls 13 of pocket 6, and two flaps 57 and 58 projecting on opposite sides of portion 56.

In FIG. 2, walls 22 and 23 are open to enable pocket 6 to be inserted easily inside pocket 7.

As wheels 4 and 5 travel further along portion T, pocket 6 is inserted inside pocket 7. At this stage, bottom wall 21 is withdrawn along axis A2, and pocket 6 penetrates pocket 7 to fold flaps 57 and 58, with respect to portion 56, about ends 45 of walls 13 of pocket 6. In the meantime, lateral walls 22 and 23 are closed, i.e. positioned parallel to each other, so that flaps 57 and 58 are folded squarely with respect to portion 56.

With reference to FIG. 4, the fold between portion 56 and flap 57 is made about end 45 of wall 13, and, being short, flap 57 is gripped completely between outer face 44 of wall 13 and inner face 47 of wall 22. With reference to FIGS. 3 and 5, the fold between portion 56 and flap 58 is made about end 45 of the other wall 13, and, being long, flap 58 is gripped partly between outer face 44 of wall 13 and inner face 49 of wall 23, and projects partly from pocket 7 to define a flap 59.

With reference to FIG. 6, as wheels 4 and 5 rotate, pockets 6 and 7 are gradually parted, so that lateral walls 13 are extracted from pocket 7. At this stage, pockets 6 and 7 swing about respective axes 11 and 20 to keep axes A1 and A2 aligned, and bottom wall 12 is gradually extracted from lateral walls 13 by cam device 16, and exerts pressure on the group and on sheet 18 of wrapping material to retain group 3 inside pocket 7 and prevent sheet 18 of wrapping material from slipping when extracting lateral walls 13 from pocket 7. With reference to FIGS. 9 and 10, once lateral walls 13 are extracted from pocket 7, plates 25 are moved into the work position, in which inner faces 52 of plates 25 rest on opposite ends of group 3 on opposite sides of bottom wall 12. In other words, faces 52 of plates 25 are coplanar with and adjacent to face 46 of bottom wall 12. Once plates 25 are moved into the work position, bottom wall 12 is withdrawn along axis A1, and group 3 and sheet 18 of wrapping material are retained firmly inside pocket 7 by plates 25.

Extracting lateral walls 13 from pocket 7 before moving plates 25 into the work position enables plates 25 to be so sized as to form, with wall 23, an extremely small passage, which extends between end 54 and face 49 of wall 23, only allows the passage of sheet 18 of wrapping material, and through which flap 59 projects (FIG. 8).

Pockets 6 and 7 are then fed along respective paths P1 and P2 and parted. Pocket 7 fed along path P2 is brought into contact with plate 32, and flap 59 is gripped partly between face 37 and ends 54 of plates 25, and is folded into an L about ends 54. As wheel 5 rotates further, pocket 7 is fed along flat portion 35 of plate 32, as shown in FIG. 7, where flap 59 is smoothed between flat face 38 and outer faces 53 of plates 25. To slide pocket 7 along plate 32, pocket 7 and plate 32 are swung about respective axes 20 and 33 to keep plates 25 parallel to flat face 38, and to grip flap 59 partly between faces 53 of plates 25 and face 38 of plate 32.

Once flap 59 is folded about ends 54, sheet 18 of wrapping material has a flap 60 projecting from pocket 7. With reference to FIG. 11, as pocket 7 slides along flat face 38 (not shown in FIG. 11 for the sake of clarity), a plate 42 engages slots 36 comb-fashion and folds flap 60 onto outer face 48 of lateral wall 22, and about the end 22*a* of lateral wall 22 as shown in FIG. 12. Once the tubular wrapping is formed and plate 42 extracted from slots 36, jaw 24 is closed to retain flap 60 between outer face 48 of wall 22 and inner face 50 of jaw 24.

Once the tubular wrapping is completed and kept closed by jaw 24, plates 25 can be extracted and restored to the rest position, and the tubular wrapping is then closed at the ends in known manner (not shown) to form a closed wrapping. Though both the tubular wrapping and the closed wrapping have flap 57 and flap 60 separated by wall 22, this in no way impairs extraction of the wrapping from pocket 7, which is done by simply opening jaw 24 and activating bottom wall 21 to slide flaps 57 and 60 with respect to wall 22 and expel the wrapped group 3. Once the wrapping is extracted from pocket 7, flaps 57 and 60 overlap. Of the advantages of the wrapping method described, it should be pointed out that, besides preventing slippage of sheet 18 of wrapping material, it also enables the formation of sharp-edged folds, which are particularly appreciated in the wrapping of cigarettes.

What is claimed is:

1. A method of wrapping elongated articles in groups, the method comprising feeding a first and a second pocket (6; 7) continuously along a first and, respectively, second path (P1, P2) having a common portion (T), along which the first pocket (6) penetrates the second pocket (7) to transfer a group (3) from the first to the second pocket (6, 7) together with a sheet (18) of wrapping material, the first and the second pocket (6, 7) comprising, respectively, a first and a second bottom wall (12; 21), and first and second lateral walls (13, 22, 23), the second bottom wall being at least as wide as a distance between the first lateral walls with the first lateral walls parallel to each other; gripping a first and a second flap (57, 58), opposite and parallel to each other, of the sheet (18) of wrapping material between the first and second lateral walls (13, 22, 23); extracting the first lateral walls (13) from the second pocket (7); and compressing the group (3) and a portion (56) of the sheet (18) of wrapping material between the first and second bottom wall (12, 21) when extracting the first lateral walls (13) from the second pocket (7).

2. The method of claim 1, further comprising folding the sheet (18) of wrapping material into a U by pushing the sheet (18) of wrapping material into the second pocket (7) by means of the ends (45) of the first lateral walls (13).

3. The method of claim 2, wherein said portion (56) extends between the ends (45) of the first lateral walls (13) and between the first and second flap (57, 58); the method providing for gripping said portion (56) between said group (3) and the second bottom wall (21).

4. The method of claim 1, wherein following extraction of the first lateral walls (13) from the second pocket (7), plates (25) on the second pocket (7) are positioned on opposite sides of the first bottom wall (12) and in a work position in which said plates (25) are coplanar with the first bottom wall (12) and crosswise to the second lateral walls (22, 23) to retain the group (3) of elongated articles (2) by opposite ends of said elongated articles (2).

5. The method of claim 4, wherein each plate (25) comprises a thin plate having an inner face (52) and an outer face (53), and a first and a second end (54, 55) opposite each other and which are respectively adjacent to the second lateral walls (22, 23) in said work position of the plates (25).

6. The method of claim 5, wherein said second ends (55) of the plates (25) are adjacent to the end (22*a*) of a second lateral wall (22) in said work position of the plates (25).

7. The method of claim 6, wherein that said second flap (58) comprises a third flap (59) projecting with respect to the plates (25); the method providing for folding said third flap (59) squarely with respect to the second flap (58) about the first ends (54) of the plates (25) and along the outer faces (53) of the plates (25) by means of a first folding device (8) located along the first path (P1).

8. The method of claim 7, further including gripping the third flap (59) partly between the outer faces (53) of the plates (25) and a flat face (38) of said first folding device (8).

9. The method of claim 7, wherein said third flap (59) comprises a fourth flap (60) projecting with respect to a second lateral wall (22); the method providing for folding said fourth flap (60) squarely with respect to the third flap (59) about the end (22*a*) of said second lateral wall (22).

10. The method of claim 9, further including gripping the fourth flap (60) between said second lateral wall (22) and a movable jaw (24) fitted in rotary manner to the second pocket (7).

11. A method of wrapping elongated articles in groups comprising:

feeding a first and a second pocket continuously along a first and second path;

placing a sheet of wrapping paper between the first and second pockets;

penetrating the first pocket into the second pocket to transfer a group of elongated articles from the first to the second pocket together with the sheet of wrapping material, the first pocket comprising a first bottom wall and a first set of lateral walls, the second pocket comprising a second bottom wall and a second set of lateral walls;

extracting the first set of lateral walls from the second pocket while compressing the group of elongated articles and a portion of the sheet of wrapping material between the first and second bottom walls; and maintaining the first and second sets of lateral walls parallel to each other during the extracting of the first set of lateral walls from the second pocket.

12. The method of claim 11, wherein the second bottom wall of the second pocket has a width equal to a distance the first set of lateral walls of the first pocket with the first lateral walls parallel to each other.

13. The method of claim 11, wherein during the penetrating, the wrapping paper has first and second portions parallel to the first and second sets of lateral walls.

* * * * *

UNITED STATES PATENT AND TRADEMARK OFFICE

CERTIFICATE OF CORRECTION

PATENT NO. : 6,820,398 B2
DATED : November 23, 2004
INVENTOR(S) : Fabrizio Talé et al.

It is certified that error appears in the above-identified patent and that said Letters Patent is hereby corrected as shown below:

Column 6,
Line 18, "wherein that" should be -- wherein --
Line 60, "distance the" should be -- distance between the --

Signed and Sealed this

Seventh Day of June, 2005

JON W. DUDAS
*Director of the United States Patent and Trademark Office*